US011608969B2

(12) United States Patent
Yaphe et al.

(10) Patent No.: US 11,608,969 B2
(45) Date of Patent: Mar. 21, 2023

(54) LUMINAIRE STRUCTURES

(71) Applicant: AXIS LIGHTING INC., Lasalle (CA)

(72) Inventors: Howard Yaphe, Lasalle (CA); Stéphane Béland, Lasalle (CA); Andrew Miles, Lasalle (CA)

(73) Assignee: Axis Lighting Inc., Lasalle (CA)

( * ) Notice: Subject to any disclaimer, the term of this patent is extended or adjusted under 35 U.S.C. 154(b) by 0 days.

(21) Appl. No.: 17/391,921

(22) Filed: Aug. 2, 2021

(65) Prior Publication Data

US 2021/0364154 A1 Nov. 25, 2021

Related U.S. Application Data

(63) Continuation-in-part of application No. 17/162,990, filed on Jan. 29, 2021, now Pat. No. 11,118,765, and
(Continued)

(51) Int. Cl.
*F21V 21/02* (2006.01)
*F21V 23/06* (2006.01)
(Continued)

(52) U.S. Cl.
CPC ..... *F21V 21/025* (2013.01); *F21V 21/005* (2013.01); *F21V 21/008* (2013.01);
(Continued)

(58) Field of Classification Search
CPC ..... F21V 21/005; F21V 21/008; F21V 23/06
See application file for complete search history.

(56) References Cited

U.S. PATENT DOCUMENTS 4,361,992 A * 12/1982 Rapp ..... F21V 21/03 52/28
5,934,786 A 8/1999 O'Keefe
(Continued)

FOREIGN PATENT DOCUMENTS

DE 202018101487 U1 4/2018
EP 3128223 2/2017
(Continued)

OTHER PUBLICATIONS

FLOS Architectural, "Infra-Structure Evo," accessed on the Internet at: https://arch.flosusa.com/systems/infra-structure-evo/, (believed to be publicly available prior to Mar. 4, 2020).
(Continued)

*Primary Examiner* — Evan P Dzierzynski
(74) *Attorney, Agent, or Firm* — Barnes & Thornburg LLP

(57) ABSTRACT

A ceiling connector assembly for mounting an article includes a ceiling connector configured to present an article-mounting end region below a downward facing ceiling surface, a canopy structure for locating on the mounting end region and configured to cover, at least in part, the mounting end region in a covering position, the canopy structure and the mounting end region each respectively including at least one first mounting structure and at least one second mounting structure, wherein when the first and second mounting structures are configured to enable the canopy structure to be removably mounted on the mounting end region in the covering position.

12 Claims, 9 Drawing Sheets

Related U.S. Application Data a continuation-in-part of application No. PCT/CA2021/051071, filed on Jul. 29, 2021.

(60) Provisional application No. 62/985,205, filed on Mar. 4, 2020.

(51) Int. Cl.

| | |
|---|---|
| ***F21V 21/008*** | (2006.01) |
| ***F21V 21/005*** | (2006.01) |
| ***F21V 21/03*** | (2006.01) |
| ***F21V 21/34*** | (2006.01) |
| *F21Y 115/10* | (2016.01) |

(52) U.S. Cl.

CPC ..... *F21V 21/03* (2013.01); *F21V 21/34* (2013.01); *F21V 23/06* (2013.01); *F21Y 2115/10* (2016.08)

(56) References Cited

U.S. PATENT DOCUMENTS

| | | | | |
|---|---|---|---|---|
| 6,761,342 | B1 * | 7/2004 | Giefer | F21S 8/061 362/403 |
| 7,503,536 | B2 * | 3/2009 | Friederich | F16M 11/043 248/343 |
| 8,240,875 | B2 | 8/2012 | Roberts | |
| 9,677,746 | B2 | 6/2017 | Ramirez | |
| 10,443,823 | B2 | 10/2019 | Beland et al. | |
| 10,443,827 | B2 | 10/2019 | Lax | |
| 10,585,229 | B1 | 3/2020 | Lax | |
| 10,788,191 | B1 | 9/2020 | Berry | |
| 10,794,580 | B1 | 10/2020 | Su | |
| 2008/0190043 | A1 | 8/2008 | Beckmann | |
| 2010/0321929 | A1 | 12/2010 | Ramirez et al. | |
| 2011/0122603 | A1 | 5/2011 | Shamshoian | |
| 2012/0063143 | A1 * | 3/2012 | Park | F21V 14/06 362/277 |
| 2014/0226316 | A1 | 8/2014 | Medendorp, Jr. et al. | |
| 2015/0267910 | A1 | 3/2015 | Lazalier | |
| 2015/0198311 | A1 | 7/2015 | O'Brien | |
| 2015/0362155 | A1 | 12/2015 | Thomsen | |
| 2017/0082253 | A1 | 3/2017 | Sorensen et al. | |
| 2017/0184290 | A1 * | 6/2017 | Chiu | F21S 8/061 |
| 2018/0313503 | A1 | 1/2018 | Sonneman | |
| 2018/0249560 | A1 | 8/2018 | Ando | |
| 2018/0251978 | A1 * | 9/2018 | Yaphe | E04B 9/18 |
| 2019/0285265 | A1 | 3/2019 | Lee | |
| 2019/0162392 | A1 | 5/2019 | Guerra | |
| 2019/0170341 | A1 | 6/2019 | Lax | |
| 2020/0284420 | A1 | 3/2020 | Cordero | |
| 2020/0217488 | A1 | 7/2020 | Beland et al. | |
| 2020/0263861 | A1 | 8/2020 | Carney | |
| 2020/0340642 | A1 * | 10/2020 | Patterson | F21V 21/008 |
| 2020/0386396 | A1 | 12/2020 | Wolfe | |
| 2020/0393099 | A1 | 12/2020 | Yaphe et al. | |

FOREIGN PATENT DOCUMENTS

| | | |
|---|---|---|
| EP | 3543605 | 9/2019 |
| KR | 102126517 | 6/2020 |

OTHER PUBLICATIONS

Focal Point, "Seem 1 Acoustic Trio, LED Direct/Indirect," Brochure accessed on-line at: https://www.focalpointlights.com/products/acoustics-pendant-suspended-linear/seem-1-acoustic-trio-unlit-ausm1tp, (Feb. 2021).

Focal Point, "Seem 1 LED Direct," Brochure accessed on-line at: https://www.focalpointlights.com/products/suspended-linear/seem-1-fsm1s, (May 2021).

Lumenalpha.TM. spot, 209272, Lumenpulse Global Tek 100 track system installation instructions (2016).

Lytespan Track lighting 9100 (1999).

Philips, Lytespan, Basic, 1 Circuit Track 6000 (2015).

Search Report & Written Opinion issued in Int'l Appl. No. PCT/CA2021/051071 (2021).

WAC Lighting, J Series 2 Circuit Track (2012).

Xal USA, "Move It System," accessed on the Internet at: https://www.xalusa.com/move-it-system, (believed to be publicly available prior to Mar. 4, 2020).

Zumtobel, "ZX2 continuous-row lighting system," accessed on the Internet at: https://www.zumtobel.com/com-en/products/zx2.html, (believed to be publicly available prior to Mar. 4, 2020).

* cited by examiner

LUMINAIRE STRUCTURES

REFERENCE TO CO-PENDING APPLICATIONS

This application is a Continuation-in-Part of copending U.S. patent application Ser. No. 17/162,990, filed Jan. 29, 2021 and entitled LUMINAIRE STRUCTURE, which claims the benefit of priority under 35 U.S.C. § 119(e) to U.S. Provisional Patent Application No. 62/985,205, filed Mar. 4, 2020 and entitled LUMINAIRE STRUCTURE, and is a Continuation-in-Part of copending PCT Patent Application: PCT/CA2021/051071, filed Jul. 29, 2021 and entitled LUMINAIRE STRUCTURE and designating the United States. The disclosures set forth in the referenced applications are incorporated herein by reference in their entireties.

Additionally, the disclosures set forth in the following applications and document are incorporated herein by reference in their entireties:

- U.S. patent application Ser. No. 16/795,153, filed Feb. 19, 2020 and entitled COUPLERS FOR LIGHT FIXTURES, U.S. Pat. No. 11,079,082;
- U.S. patent application Ser. No. 15/299,168, filed Oct. 20, 2016 and entitled COUPLERS FOR LIGHT FIXTURES, now granted as U.S. Pat. No. 10,215,380;
- U.S. patent application Ser. No. 16/256,356, filed Jan. 24, 2019 and entitled COUPLERS FOR LIGHT FIXTURES, now granted as U.S. Pat. No. 10,584,857;
- U.S. Pat. App. No. 62/820,083 filed Mar. 18, 2019 and entitled MOUNT INTERFACE FOR LIGHT FIXTURES;
- U.S. patent application Ser. No. 16/723,665 filed Dec. 20, 2019 and entitled MOUNT INTERFACE FOR LIGHT FIXTURES; and
- Appendix to the specification filed with the present application.

FIELD OF THE DISCLOSURE

The present disclosure relates to luminaire structures and other ceiling mountable articles.

BACKGROUND

Pendant luminaires are those which are suspended from a structure, such as a fixture mounting harness, from a ceiling mounted junction box or the like. In the ubiquitous t-bar type ceiling configuration, for example, a t-bar connector is fastened to an individual t-bar and provides a convenient mounting location. A threaded member extends downwardly from the t-bar connector to couple with a mating threaded connector on the fixture mounting harness. A cover plate, called a canopy, is typically used to cover the coupling to provide a clean finish.

SUMMARY

In an aspect, there is provided a ceiling connector assembly for mounting an article, comprising a ceiling connector configured to present an article-mounting end region below a downward facing ceiling surface, a canopy structure for locating on the mounting end region and configured to cover, at least in part, the mounting end region in a covering position, the canopy structure and the mounting end region each respectively including at least one first mounting structure and at least one second mounting structure, wherein when the first and second mounting structures are configured to enable the canopy structure to be removably mounted on the mounting end region in the covering position.

In some example embodiments, the first mounting structure and the second mounting structure are configured to rotatably engage so as to secure the canopy structure in a first mounted position on the mounting end region.

In some example embodiments, the first mounting structure is selected from one of a post structure and a sleeve structure, and the second mounting structure is selected from another of the post structure and the sleeve structure.

In some example embodiments, the post structure and sleeve structure include respective outer and inner threaded portions.

In some example embodiments, the inner threaded portion on the sleeve structure includes an inner passage having a first threaded section with a first diameter to threadably engage a corresponding outer threaded portion on the post structure.

In some example embodiments, the inner passage has a second section with a second diameter which is dimensioned to receive a stem structure therein.

In some example embodiments, the stem structure includes a stem inner passage with a stem inner threaded portion to threadably engage the post structure.

In some example embodiments, the sleeve structure and/or the post structure are/is configured for the post structure to project beyond the sleeve structure when the canopy structure is in the first mounted position.

In some example embodiments, the sleeve structure and post structure are configured so that the inner passage is annular shaped to receive the stem structure.

In some example embodiments, the stem structure is configured to extend axially along the inner passage.

In some example embodiments, the stem inner passage is in communication with a cavity adjacent the ceiling connector to form a passageway for wiring therebetween to power the article to be mounted on the stem structure.

In another aspect, there is provided an article assembly comprising a ceiling connector configured to present an article-mounting end region below a downward facing ceiling surface region, a canopy structure for locating on the mounting end region and configured to cover, at least in part, the mounting end region in a covering position, the canopy structure and the mounting end region each respectively including at least one first mounting structure and at least one second mounting structure, wherein when the first and second mounting structures are configured to enable the canopy structure to be removably mounted on the mounting end region in the covering position, and an article for mounting on the article-mounting end region.

In some example embodiments, the article is a luminaire structure.

In some example embodiments, the ceiling connector may include an anchor structure releasably securable relative to the ceiling structure, the cross arm structure including a pair of opposed arm sections with respective and opposed end regions, and a central location structure to support the mounting end region.

In some example embodiments, the respective and opposed end regions may be configured to be at a first elevation, and wherein the central location structure is configured to be at a second elevation.

In some example embodiments, the first elevation is configured to be above, substantially parallel to, or below the second elevation.

In another aspect, there is provided a canopy structure for engaging a mounting structure relative to a ceiling, comprising a through passage with a first region to receive and engage the mounting structure, and a second region to receive a stem structure therein and which is engaged with the mounting structure.

In another aspect, there is provided a method for mounting an article on a ceiling, comprising:

providing a canopy structure configured with a through passage with a first region to receive and engage a mounting structure downwardly extending from the ceiling, and a second region to receive a stem structure therein and which is engaged with the mounting structure, engaging the first region with the mounting structure so that the canopy structure is positionable relative to a ceiling surface, and aligning the stem structure with the second region, and engaging the stem structure with the mounting structure, so that the stem structure is positionable in the second region relative to the ceiling surface.

In another aspect, there is provided a method for mounting a grid lighting network relative to a ceiling region, comprising:

providing a plurality of connector assemblies according to claim 1;

providing a corresponding plurality of stem structures for adjustable mounting to a corresponding connector assembly;

providing a plurality of grid segments configurable with a number of hub structures to be assembled into the grid lighting network;

associating each of stem structures with one or more of the grid segments and/or hub structures, and one of the connector assemblies;

establishing the grid lighting network in an assembled position, at least in part, with one or more of the stem structures extending between a corresponding connector assembly and the one or more grid segments and/or hub structures, adjusting an elevational position of one or more of the stem structures relative to the corresponding connector assembly to establish a designated orientation of the grid lighting network relative to the ceiling region.

In some example embodiments, the designated orientation may be a substantially level orientation relative to a reference surface.

BRIEF DESCRIPTION OF THE FIGURES

Several exemplary embodiments of the present disclosure will be provided, by way of examples only, with reference to the appended drawings, wherein.

DETAILED DESCRIPTION

Figure 1:
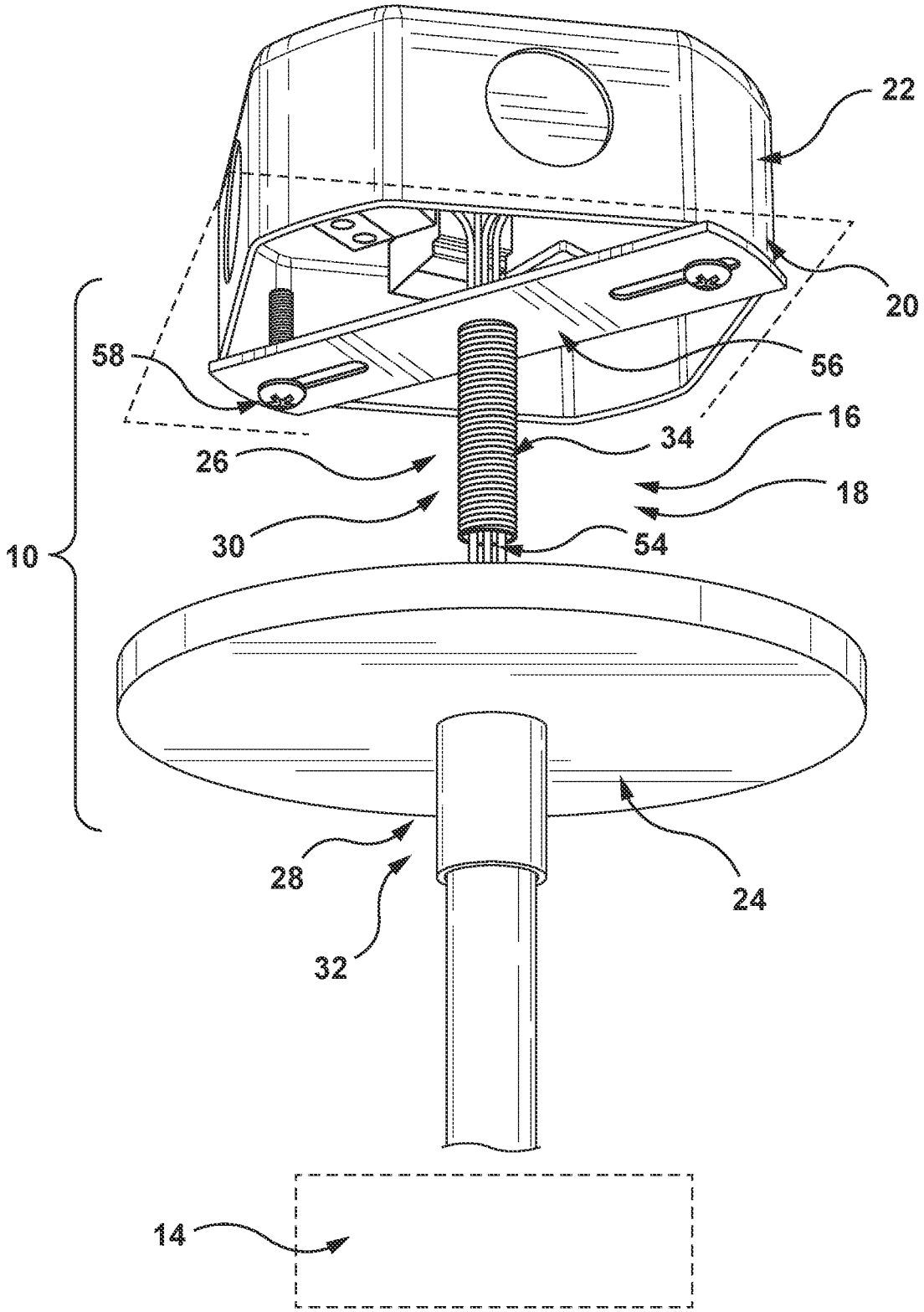
FIGS. 1 to 3 are schematic perspective assembly views in different configurations of a ceiling connector assembly for an article, such as a luminaire structure.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical, mechanical or other connections or couplings. The terms upper, lower, and vertical are intended for operative context only and are not necessarily intended to limit the invention only to those configurations or orientations. Furthermore, and as described in subsequent paragraphs, the specific mechanical and/or other configurations illustrated in the drawings are intended to exemplify embodiments of the invention. However, other alternative mechanical and/or other configurations are possible which are considered to be within the teachings of the instant disclosure.

The term "ceiling connector" means a connector which is configured to connect with a ceiling structure. Suspended ceilings are examples of such ceiling structures and include a number of ceiling structural units called "t-bars". Other ceiling structures may be associated with building structures such as those providing supporting floor surfaces. For example, in some factory-type office environments, the space usually above a suspended ceiling structure which usually locates electrical and ventilation corridors, lighting effects can provide a sight line which may define a perceived ceiling.

Referring to the figures, in particular FIG. 1, there is provided a ceiling connector assembly 10 for mounting an article shown schematically at 14, such as a luminaire structure. The assembly 10 comprises a ceiling connector 16 configured to present an article-mounting end region 18 below or relative to a downward facing ceiling surface region shown in dashed lines at 20, below a junction box 22. A canopy (or cover) structure is provided at 24 for locating on the mounting end region 18, and is configured to cover, at least in part, the mounting end region 18 in a covering position, as shown in FIG. 2.

The mounting end region 18 and the canopy structure 24 each, respectively, have at least one first mounting structure 26 which may be integrally formed with the mounting end region 18, and at least one second mounting structure 28 which may be integrally formed with the canopy 24. The first and second mounting structures 26 and 28 are configured to enable the canopy structure 24 to be removably mounted on the mounting end region 18 in the covering position of FIG. 2.

Figure 2:
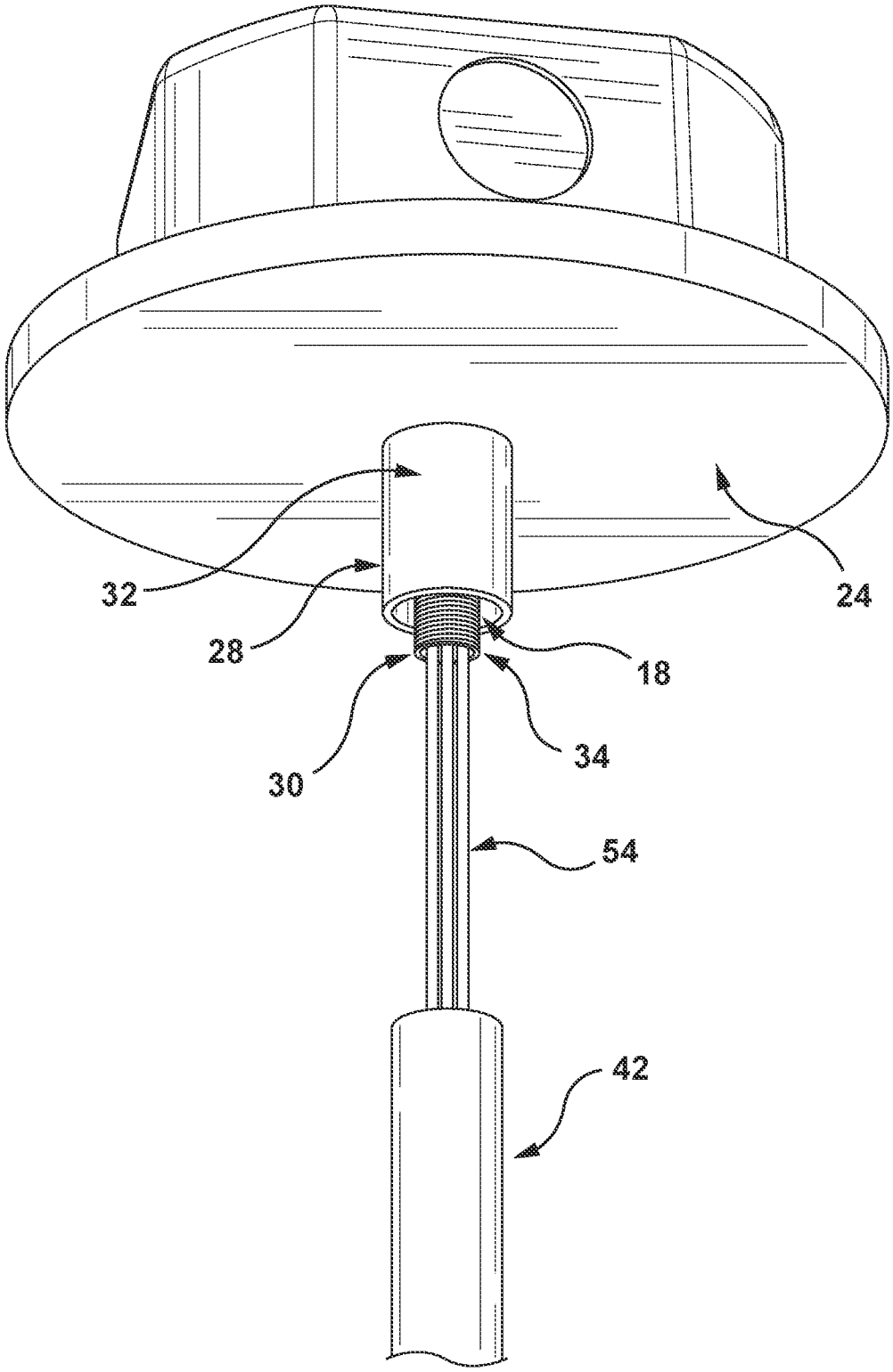

In some example embodiments, the first mounting structure 26 and the second mounting structure 28 may be configured to rotatably secure the canopy structure 24 in a first mounted position on the mounting end region, as shown in FIG. 2, though other configurations may also be deployed such as by way of slotted or other engagements releaseably retained in place by way of pins, spring loaded balls or the like, as examples. The first mounting structure 26 may be provided in the form of a threaded post structure 30, while the second mounting structure 28 may be included in a sleeve structure 32, and which in turn may be provided with an inner threaded portion 36, as shown in FIG. 5.

Figure 4:
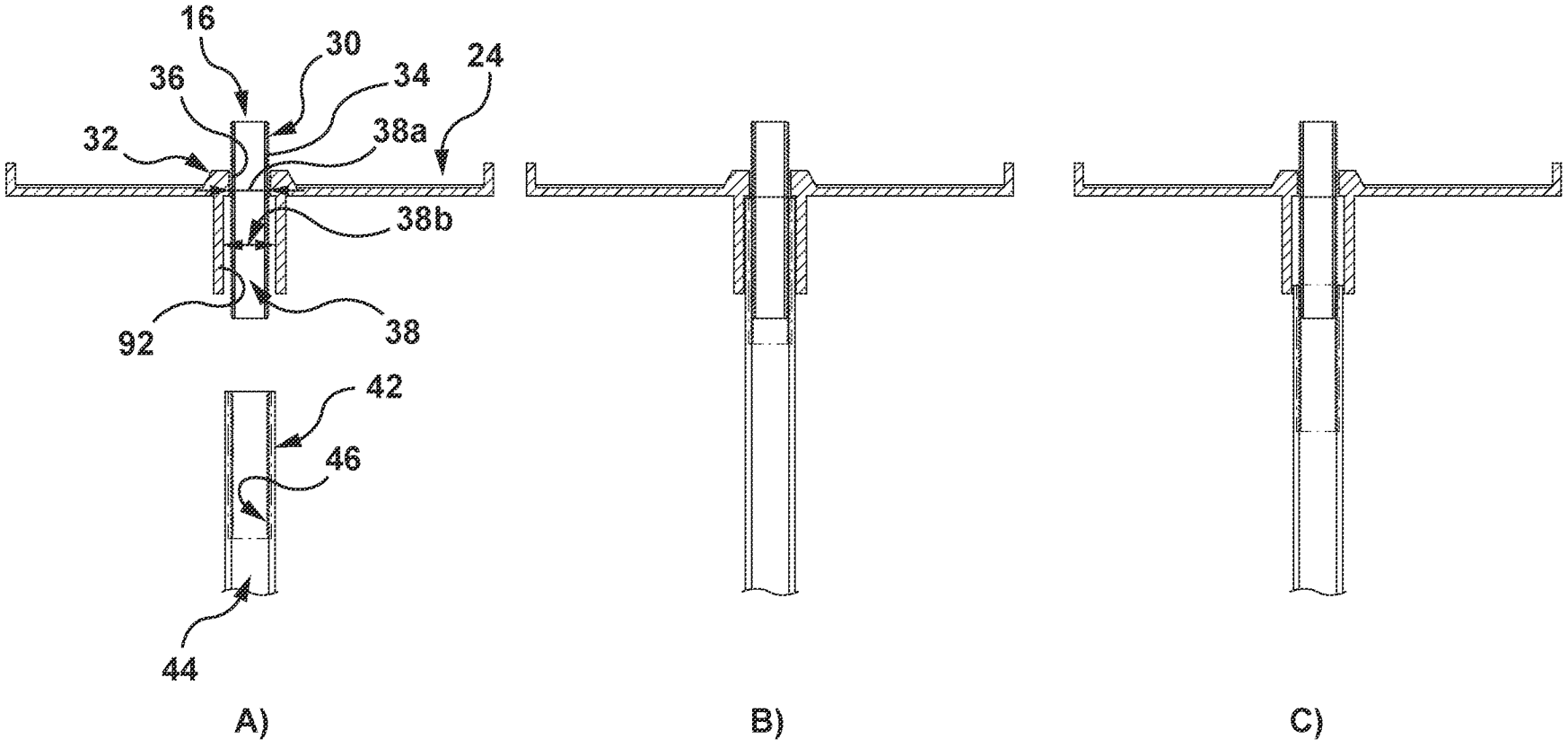
FIGS. 4A to 4C are sectional views of the ceiling connector assembly of FIG. 1 in different configurations.

In this case, as can be seen in FIG. 4, the inner threaded portion 36 on the sleeve structure 32 may configured to provide or include an inner passage 38 having a first section 38*a* with a first diameter to threadably engage the corresponding outer threaded portion 34 on the post structure 30, and a second threaded or non-threaded section 38*b*. In this example embodiment, the second section is non-threaded and is provided with or includes a second diameter to receive a stem structure 42. The stem structure 42 may itself be provided with an inner passage 44 having inner thread portion 46 to threadably engage the post structure 30. In some example embodiments, the sleeve structure 32 and the post structure 30 may be provided on the ceiling structure 16 and the canopy structure 24 respectively.

Figure 5:
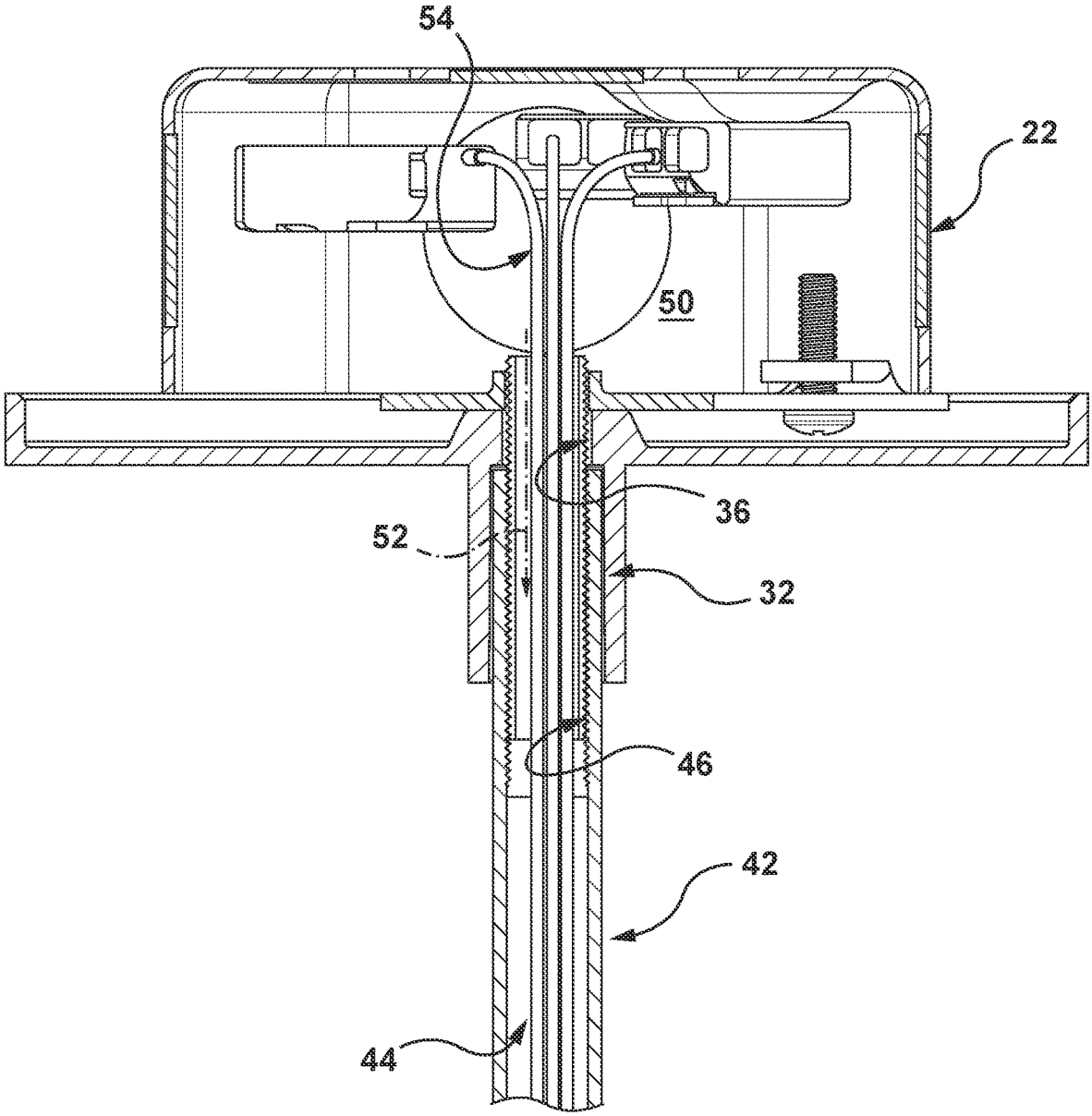
FIGS. 5 and 7 are magnified sectional views of the ceiling connector assembly of FIG. 1 in different configurations.
Figure 6:
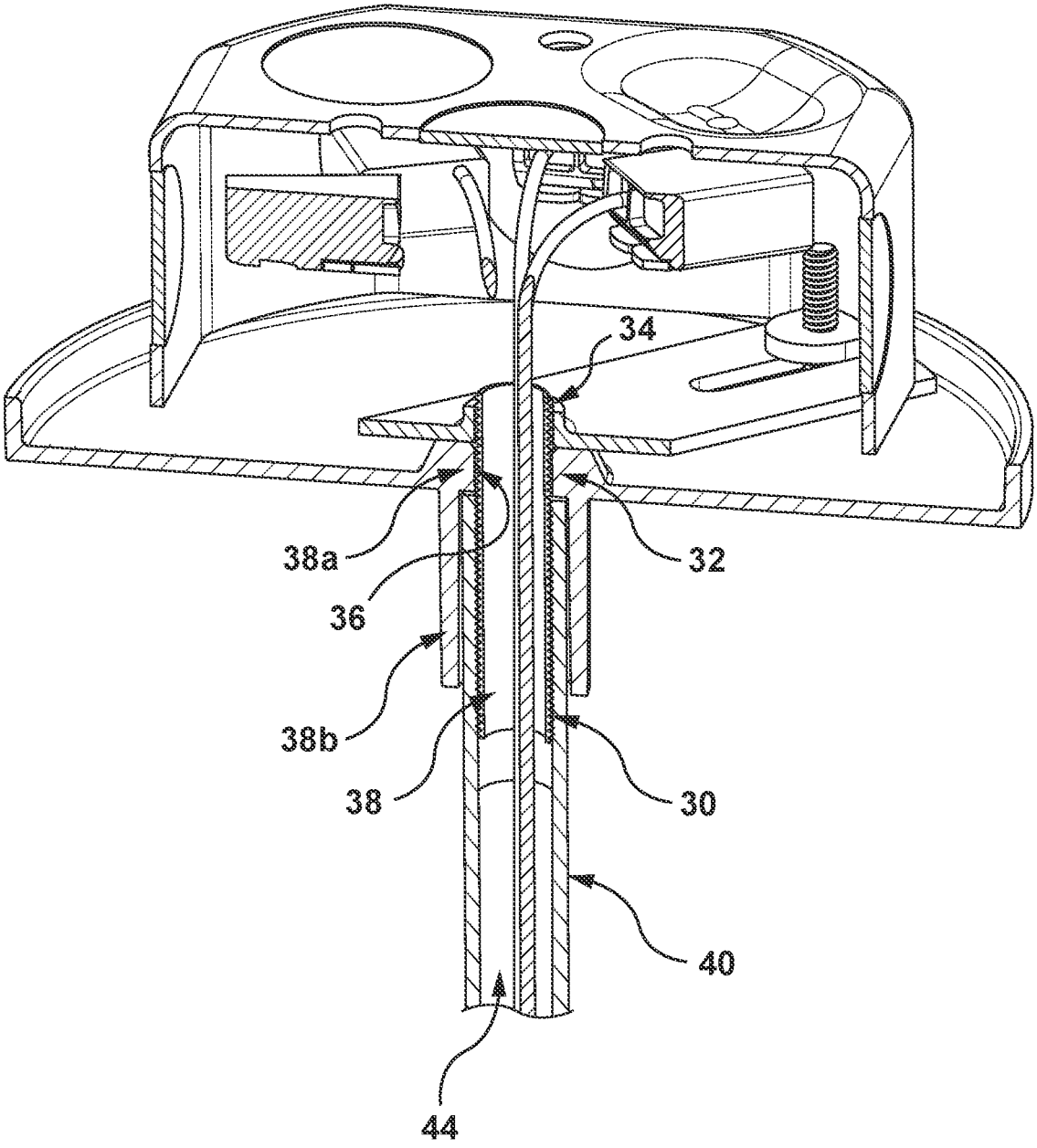
FIG. 6 is a downward perspective sectional view of the ceiling connector assembly of FIG. 1 in the configuration of FIG. 5.
Figure 7:
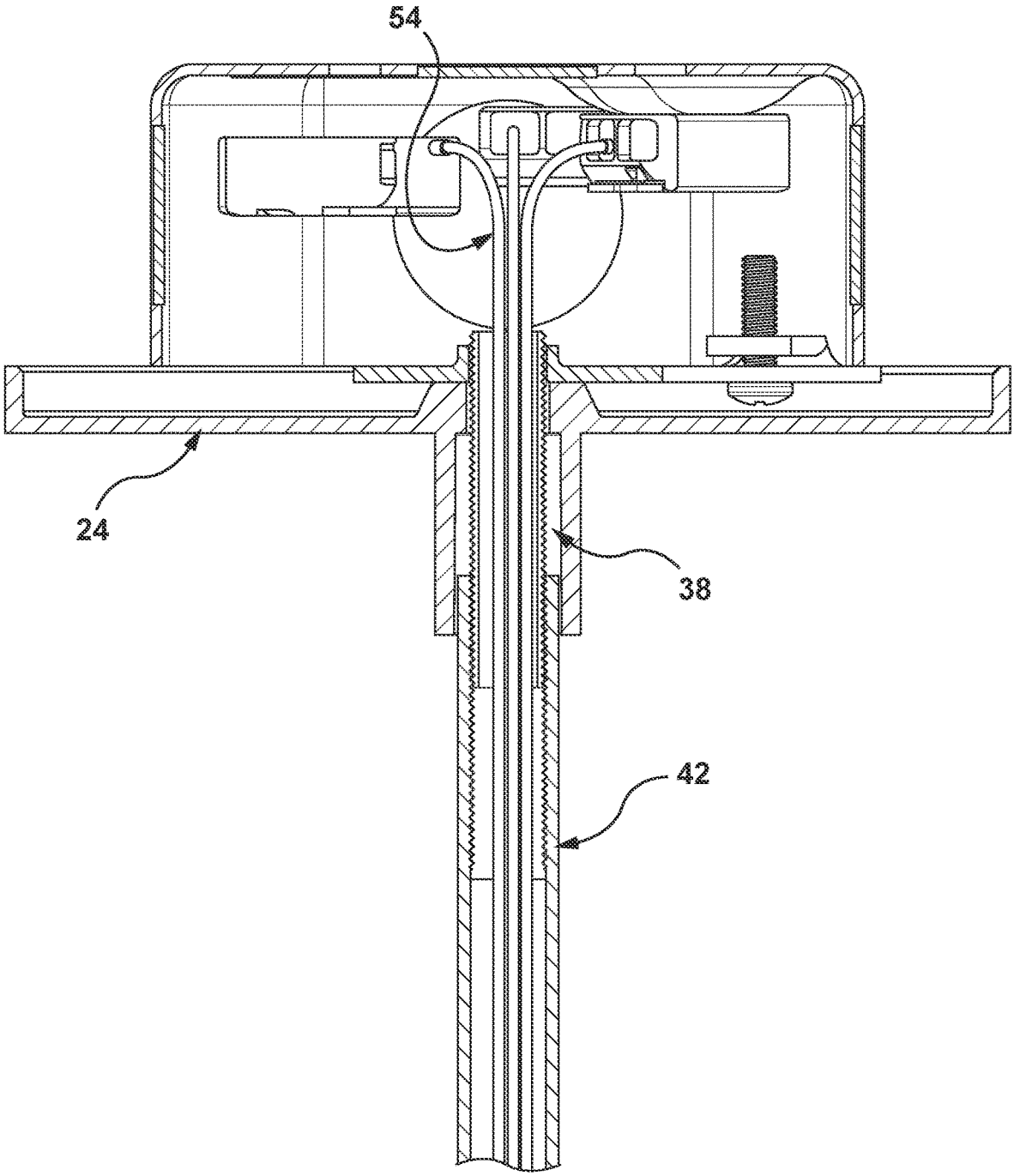

In some example embodiments, as can be seen in FIGS. 5 to 7, the sleeve structure 32 and/or the post structure 30 may be configured for the post structure 30 to project beyond the sleeve structure 32 when the canopy structure 24 is in the first mounted position. The sleeve structure 32 and post structure 30 may be configured so that the inner passage 38 (FIG. 7) is annular shaped to receive the stem structure 42. The stem structure 42 is further configured to extend axially along the inner passage 38, during progressive threading with the post structure 30. Referring to FIG. 5, the stem inner passage 44 may thus be communication with a cavity 50 adjacent the ceiling connector 16 and with the junction box 22, to form a passageway, shown in chain dotted lines at 52, for wiring 54 therebetween to power the article 14 to be mounted on the stem structure 42.

In use, the junction box 22 may be located and the first mounting structure 26 installed as shown in FIG. 1, with the post structure 30 threaded into place in a mating passage in a cross arm 56, itself to be held by fasteners 58 threaded into corresponding threaded receivers (not shown) in the junction box 22, and with the wiring 54 fed through the passageway 52 (FIG. 5) for later coupling with the luminaire structure 14.

Figure 3:
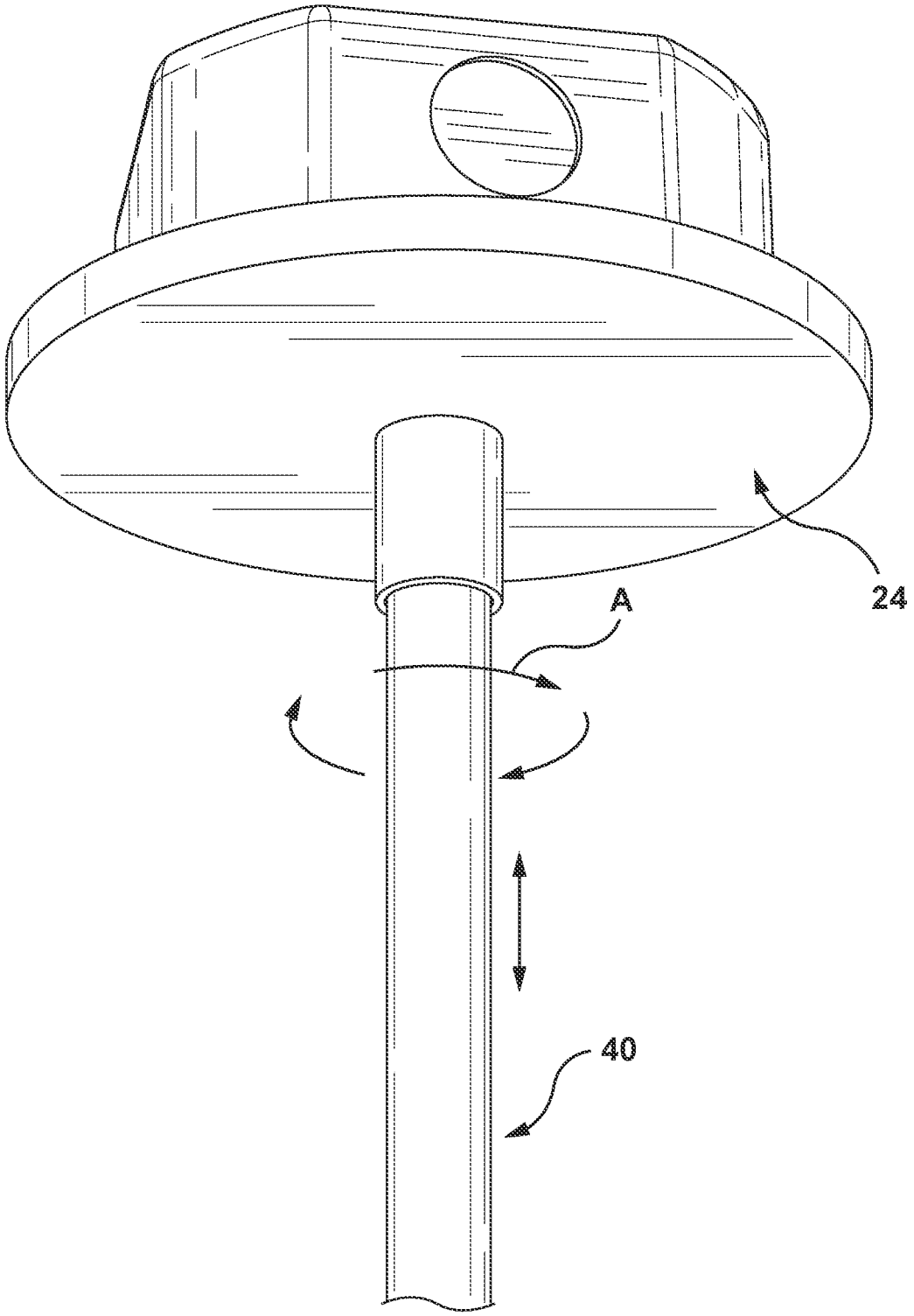

Next, as seen in FIG. 2, the sleeve structure 32 of the canopy structure 24 may be oriented so that the inner threaded portion 36 (on the first section 38*a*) may be aligned with the outer threaded portion of the post structure 30. The canopy structure 24 may then be rotated as shown by arrows A in FIG. 3 to advance the canopy structure 24 along the post structure 30, for instance in a clockwise sense to advance the canopy structure 24 toward the junction box 22, thus causing the canopy structure 24 to approach, and which may contact the ceiling surface region 20, to cause the post structure 30 to emerge from below the sleeve structure 32, as shown in FIGS. 2 and 4. Next, the stem structure 42 may be oriented so that the stem inner threaded portion 46 is aligned with the outer threaded portion 34 and likewise threaded thereon when rotated in a clockwise sense, after the wiring is fed into the stem inner passage 44. In this instance, the stem structure 42 is received in the second section 38*b* of the sleeve structure, and thus extends along the second section 38*b* and can thus provide a degree of vertical travel adjustability according to such things as a desired elevation of the luminaire structure 14 relative to the ceiling surface region 20, as can be seen by an position in FIG. 4B and a lower position in FIG. 4C.

Thus, in some example embodiments, the canopy structure 24 may be configured to cover the junction box 22 and associated structure thereof, or other ceiling structures which may not involve the junction box 22, while providing access to the post structure 30, and the inner passage 38 which may be annular in shape owing to the presence of the post structure 30 therein, to provide a sufficient vertical direction of travel of the stem structure on the post structure, to allow for adjustments in height of the article 14 (as shown in FIGS. 4B and 4C). Meanwhile, the threaded interface between the post structure 30 and the stem structure 42 may be concealed by the second mounting structure 28.

Figure 8:
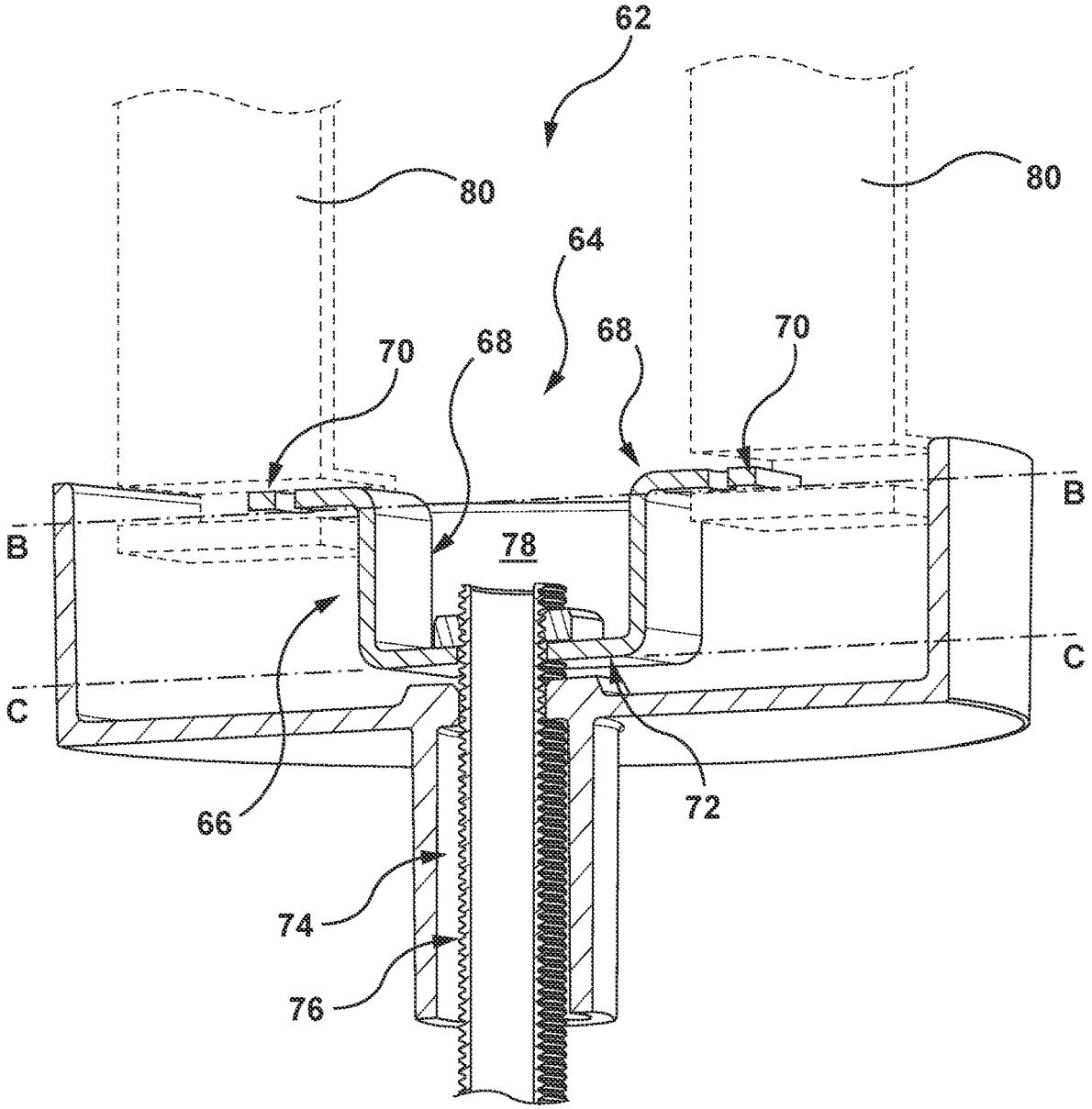
FIG. 8 is a fragmentary perspective sectional view of another ceiling connector assembly for an article.

In another example embodiment as shown in FIG. 8, a ceiling connector 62 may include an anchor structure 64 releasably securable relative to a ceiling structure. A cross arm structure 66 may be provided which includes a pair of opposed arm structures 68 with respective and opposed end regions 70, and a central location structure 72 to support the mounting end region 74, in this this case including a post structure 76. The respective and opposed end regions 70 may be configured to be at a first elevation B, and wherein the central location structure is configured to be at a second elevation C. In this case, the first elevation B may be configured to be above, substantially parallel to, or below the second elevation C. Where the first and second elevations B and C are different, the cross arm structure 66 may provide a passage in the region 78 for such things as wiring.

Thus, the opposed end sections 68 may be configured to engage and/or accommodate other mounting configurations with one or more corresponding ceiling structures, for example as shown at 80.

Figure 9:
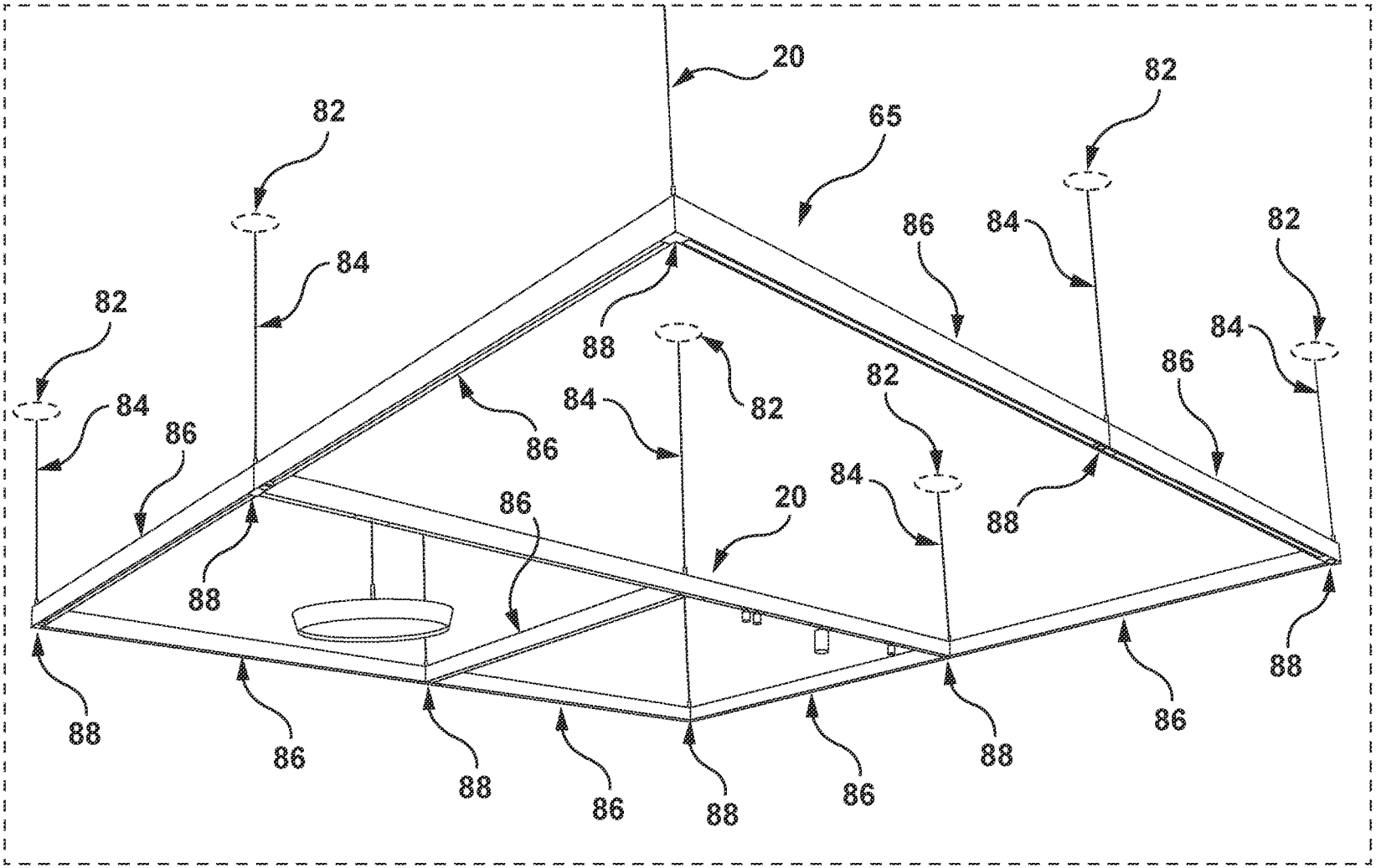
FIG. 9 is a perspective view of a grid lighting network.

Thus, with reference to U.S. patent application Ser. No. 17/162,990, example embodiments herein may provide a method for mounting a grid lighting network as shown at 65 in FIG. 9, relative to a ceiling region. This may involve providing a plurality of connector assemblies shown in dashed lines at 82, for example, as disclosed herein, as well as a corresponding plurality of stem structures 84 for adjustable mounting to a corresponding connector assembly. Next, a plurality of grid segments 86 configurable with a number of hub structures 88 may be assembled into the grid lighting network 65. Each of the stem structures 84 may be associated with one or more of the grid segments 86 and/or hub structures 88, and one of the connector assemblies 82. The grid lighting network 65 may be established in an assembled position, at least in part, with one or more of the stem structures 84 extending between a corresponding connector assembly 82 and the one or more grid segments 86 and/or hub structures 88. The elevation position of one or more of the stem structures 84 may be adjusted, as needed, relative to the corresponding connector assembly 82 to establish a designated orientation of the grid lighting network 65 relative to the ceiling region (not shown). In some cases, the designated orientation may be a level orientation relative to a reference surface, such as the floor (not shown).

While the present disclosure describes various exemplary embodiments, the disclosure is not so limited. To the contrary, the disclosure is intended to cover various modifications and equivalent arrangements, as will be readily appreciated by the person of ordinary skill in the art.

The invention claimed is:

1. A ceiling connector assembly for mounting an article, comprising a ceiling connector configured to present an article-mounting end region below a downward facing ceiling surface, a canopy structure for locating on the mounting end region and configured to cover, at least in part, the mounting end region in a covering position, the mounting end region and the canopy structure each respectively including at least one mounting post structure and at least one mounting sleeve structure, wherein the mounting post structure and the mounting sleeve structure are configured to enable the canopy structure to be removably mounted on the mounting end region in the covering position, the mounting-post structure and the mounting sleeve structure including respective outer and inner threaded portions, wherein the inner threaded portion on the mounting sleeve structure includes an inner passage having a first threaded section with a first diameter to threadably engage a corresponding outer threaded portion on the mounting post structure, and wherein the inner passage has a second section with a second diameter which is dimensioned to receive a stem structure therein.

2. The assembly of claim 1, wherein the stem structure includes a stem inner passage with a stem inner threaded portion to threadably engage the mounting post structure.

3. A ceiling connector assembly for mounting an article, comprising a ceiling connector with at least one mounting post structure configured to present an article-mounting end region below a downward facing ceiling surface, a canopy structure for locating on the mounting end region and configured to cover, at least in part, the mounting end region in a covering position, the canopy structure including at least one mounting sleeve structure, wherein the at least one mounting post structure and the at least one mounting sleeve structure are configured to enable the canopy structure to be removably mounted on the mounting end region in the covering position, the at least one mounting post structure and the at least one mounting sleeve structure including respective outer and inner threaded portions, wherein the inner threaded portion includes an inner passage having a first threaded section with a first diameter to threadably engage the corresponding outer threaded portion on the at least one mounting post structure, wherein the at least one mounting sleeve structure and/or the at least one mounting post structure are/is configured for the mounting post structure to project beyond the mounting sleeve structure when the canopy structure is in the first mounted position.

4. The assembly of claim 3, wherein the at least one mounting sleeve structure and the at least one mounting post structure are configured so that the inner passage is annular shaped to receive the stem structure.

5. The assembly of claim 4, wherein the stem structure is configured to extend axially along the inner passage.

6. The assembly of claim 5, wherein the stem inner passage is in communication with a cavity adjacent the ceiling connector to form a passageway for wiring therebetween to power the article to be mounted on the stem structure.

7. A canopy structure for locating on a mounting end region of a ceiling connector for mounting an article below a downward facing ceiling surface, comprising at least one mounting structure configured to enable the canopy structure to be removably mounted on the mounting end region in the covering position, wherein the mounting end region and the mounting structure include respective outer and inner threaded portions, and the inner threaded portion on the mounting structure includes an inner passage having a first threaded section with a first diameter to threadably engage a corresponding outer threaded portion on the mounting end region, wherein the inner passage has a second section with a second diameter which is dimensioned to receive a stem structure therein.

8. The assembly of claim 7, wherein the stem structure includes a stem inner passage with a stem inner threaded portion to threadably engage the mounting end region.

9. The assembly as defined in claim 7, wherein the mounting structure and/or the mounting end region are/is configured for the mounting end region to project beyond the mounting structure when the canopy structure is in a first mounted position.

10. The assembly of claim 9, wherein the mounting structure and mounting end region are configured so that the inner passage is annular shaped to receive the stem structure.

11. The assembly of claim 10, wherein the stem structure is configured to extend axially along the inner passage.

12. The assembly of claim 11, wherein the stem inner passage is in communication with a cavity adjacent the ceiling connector to form a passageway for wiring therebetween to power the article to be mounted on the stem structure.

* * * * *